US005526591A

United States Patent [19]

Otwell

[11] Patent Number: 5,526,591

[45] **Date of Patent: *Jun. 18, 1996**

[54] EXCAVATION BUCKET AND METHOD OF DIGGING

[76] Inventor: William C. Otwell, 758 NW. Holland Rd., Rome, Ga. 30165-8865

[ * ] Notice: The term of this patent shall extend beyond the expiration date of Pat. No. 5,416,990.

[21] Appl. No.: 308,984

[22] Filed: Sep. 20, 1994

Related U.S. Application Data

[63] Continuation-in-part of Ser. No. 165,296, Dec. 13, 1993.

[51] Int. Cl.[6] ..... E02F 3/40

[52] U.S. Cl. ..... 37/444; 37/379; 414/722

[58] Field of Search ..... 37/418, 379, 393, 37/445, 444, 443, 411; 414/722, 725; 172/371, 378, 381; 294/55, 51, 54.5, 63.26

[56] References Cited

U.S. PATENT DOCUMENTS

| | | | |
|---|---|---|---|
| 1,824,989 | 9/1931 | Fundom | 414/722 X |
| 2,203,713 | 6/1940 | Austin | 37/418 |
| 2,959,305 | 11/1960 | Konefes | 37/445 X |
| 3,056,219 | 10/1962 | Jeffrey | 414/722 X |
| 3,109,248 | 11/1963 | Vos | 414/722 X |
| 3,247,606 | 4/1966 | Page | 37/398 |
| 3,869,054 | 3/1975 | Moreau | 37/344 |
| 3,897,641 | 8/1975 | Moser | 414/722 X |
| 4,157,956 | 6/1979 | Robinson | 414/722 X |
| 4,230,435 | 10/1980 | Azevedo | 414/722 |
| 4,501,334 | 2/1985 | Ptacek | 172/832 |
| 4,633,601 | 1/1987 | Fleck et al. | 37/444 |
| 4,943,165 | 7/1990 | Boggs | 414/722 X |
| 5,253,449 | 10/1993 | Webb et al. | 37/444 X |
| 5,353,531 | 10/1994 | Doucette | 37/444 |
| 5,416,990 | 5/1995 | Otwell | 37/444 X |

*Primary Examiner*—Dave W. Arola
*Assistant Examiner*—Victor Batson
*Attorney, Agent, or Firm*—Jones & Askew

[57] ABSTRACT

An excavation bucket includes a bottom assembly which defines a scoop slot opening along a portion of the bottom assembly. The excavation bucket is useful for excavating material in a conventional manner in a first operating mode, and for fine-grading material in a novel manner in a second operating mode. When operating in the second operating mode the excavation bucket is capable of fine-grading adjacent buried objects without damaging the buried objects.

19 Claims, 5 Drawing Sheets

EXCAVATION BUCKET AND METHOD OF DIGGING

CROSS-REFERENCE TO RELATED APPLICATION

This is a continuation-in-part application of U.S. patent application Ser. No. 08/165,296, filed Dec. 13, 1993.

FIELD OF THE INVENTION

This invention relates in general to excavation buckets, and relates in particular to a backhoe or escavator bucket.

BACKGROUND OF THE INVENTION

Excavation equipment with excavation buckets for digging and grading has been known for many years. The buckets themselves have been developed and refined over the years to increase the digging efficiency of such devices. Excavation buckets are typically adapted to backhoes. A backhoe is a type of excavation equipment which includes, generally, a tractor and an articulating, hinged arm assembly attached to the tractor. The arm assembly is mechanically interconnected at one end to the tractor and at its opposing end to an excavation bucket. In use, the bucket is extended away from the tractor, engaged with the material being excavated, and then drawn toward the tractor to scoop the material into the bucket.

A typical excavation bucket comprises, generally, a pair of spaced-apart side plates and a bottom plate joined along edge portions of the side plates to define a material-containing volume therein. A leading edge of the bucket, defined by the leading edge of the bottom plate, may be provided with a plurality of teeth for improved digging action. The rear of the bucket is provided with mounting plates defining holes for mounting the bucket onto the arm of a backhoe.

In this conventional configuration, the bottom plate of the bucket is a continuous plate extending from the front of the bucket to the rear of the bucket. The profile of the bottom plate is typically arcuate, defining a varying radius of curvature along different portions of the bottom plate. During use, the bucket is rotated by the backhoe arm while the leading edge of the bucket is forced into the material being excavated. The configuration of the bottom plate, and of the bucket generally, is such that the bottom plate slides relative to the material and provides little resistance to movement of the bucket. The leading edge of the bucket, at which the teeth are located, is typically the widest transverse portion of the bucket and the portion of the bucket that extends deepest into the trench. This configuration insures that there will be little or no interference between the bucket side plates and the sidewalls of the excavated trench or ditch.

Backhoes are particularly effective for digging trenches and ditches. However, the conventional backhoe bucket becomes difficult to operate when working near building foundations or other locations where buried building service conduits and pipes may extend from the building near the location of excavation. For example, electrical cables, either direct-buried or disposed in buried conduits, water mains, and gas lines, are often buried in the ground adjacent building foundations. When excavating with a conventional bucket near locations known or suspected to include buried objects, it becomes necessary to remove only shallow layers of material as the depth of the trench approaches the buried depth of the buried object. Failure to excavate with caution near the buried object could result in the excavation bucket snagging, rupturing, or otherwise damaging the structure, possibly with catastrophic consequences.

Further, when laying pipe or other conduit in excavated trenches, the final grading of the trench must be carefully and precisely made to ensure proper slope and foundation for the pipe or conduit. This type of operation is difficult to perform with a conventional backhoe bucket because the toothed leading edge of the bucket is not designed to remove shallow layers of excavation material or to permit fine-grading of material to be excavated.

SUMMARY OF THE INVENTION

Accordingly, an object of the present invention is to provide an improved excavation bucket, particularly an improved backhoe bucket.

Another object of the present invention is to provide an excavation bucket with a scoop formed into the bottom thereof to allow fine-grading with the excavation bucket.

A further object of the present invention is to provide an excavation bucket that can be used in one mode for digging, and in another mode for grading.

Another object of the present invention is to provide an excavation bucket with a scoop formed in a bottom plate thereof, which is capable of fine-grading adjacent buffed objects, particularly cylindrically shaped objects buffed in the excavation path, without disturbing or damaging the buffed object.

Stated generally, the excavation bucket according to the present invention utilizes a conventional configuration modified with a scoop provided on the bottom portion of the bucket. This configuration allows the bucket to be utilized in a conventional manner for fast digging in a first mode, and in a novel manner for fine-grading with the scoop in a second mode.

Stated in greater detail, the scoop is formed in the bottom plate of the excavation bucket by providing front and rear bottom plate portions which are attached to the side plates to form an elongate scoop slot extending from one side plate to the other side plate. The slot is defined by edges defined along adjacent edges of the front and rear bottom plate portions. The bottom plate edges are displaced such that the edge along the rear bottom plate is lower, relative to the bucket opening, than the edge along the front plate. This configuration is fixed and allows the scoop to excavate up to a maximum depth into the material to be excavated. An outer surface of the front bottom plate supports the bucket on the material during fine-grading and positions the slot edge of the rear bottom plate at a fixed depth below the surface. The excavation depth can be varied by changing the attitude of the engagement of the outer surface of the front bottom plate in relation to the material to be excavated.

In one embodiment of the present invention the front and rear bottom plate portions are arcuate. In another embodiment of the present invention the front bottom plate portion is substantially planar and the rear bottom plate portion may be arcuate or planar or comprise planar and curved portions. The type of material to be excavated and the excavation conditions may dictate or suggest which configuration of bottom plate portions to use.

The bucket may be provided with bucket guide plates disposed in engagement with and substantially co-planar to the side plates. The bucket guide plates define guide edges that extend slightly past the outer surface of the front bottom plate portion from the front portion of the bucket adjacent the teeth to the rear bottom plate edge defining the scoop slot. The guide edges of the guide plates are effective to prevent the rear slot edge from engaging buried objects, including conduits and pipes. The guide edges act as guide surfaces that will engage a buried object as the bucket approaches the buried object. As the bucket is drawn closer to the tractor the guide edges ride along the burried object, thrusting the bucket in an upward direction. As the scoop draws closer to the buried object the guide surfaces continue to ride along the object causing the rear slot edge to disengage the buried object and pass over it. After the rear slot edge has passed the buried object the guide surfaces no longer engage the buried object and the rear slot edge drops down and resumes fine-grading the material.

The scoop is located so that the bucket will retain a substantial amount of material while digging and removing in the conventional manner without material exiting through the scoop slot. Specifically, the scoop is located along the bottom of the bucket so that there exists a substantial fillable bucket volume behind the scoop. Thus, the rear bottom section and the side plates provide an interior bucket volume that can retain material to allow complete excavation and removal by the bucket.

The performance of the bucket according to the present invention can be improved by providing a closure for the scoop slot to prevent material that has entered the bucket, during either regular excavation or fine-grading, from exiting through the scoop slot. It is possible to provide a control valve or the like at the scoop for selectively controlling the movement of material through the scoop slot. However, such a closure would tend to be complex and not durable enough to withstand heavy digging. Thus, a passive one-way valve such as a resilient flap is particularly suitable for use in the present invention.

A resilient flap, for example, made of a molded rubber composition, is optionally provided to act as a one-way valve for material passing through the scoop into the bucket while preventing material flow in the opposite direction. The resilient flap is preferably mounted within the scoop to prevent damage thereto during operation of the bucket. The flap can be mounted to extend downwardly from a trailing edge of the front bottom section of the bucket, or can be mounted to extend upwardly from a leading edge of a rear bottom section of the bucket. The free end of the resilient flap must contact and cooperate with other structure inside the bucket acting as a stop to prevent its rotation when operating in the excavation mode to prevent material flow from the bucket.

The wear characteristics of the bucket can be enhanced by providing wear plates and guides at appropriate positions on the bucket. For example, a wear plate can be provided either above or below, or both, relative to a leading edge of the rear bottom section at the scoop. This prevents wear of the leading edge of the rear bottom section. The wear plates can be mounted to be replaced, or removed and repaired, as required. Likewise, a lower wear plate can be provided at the trailing edge of the front bottom section.

The wear plate(s) and combination of wear plates can be provided for changing or modifying the configuration of the scoop slot. Specifically, the wear plates can be added to make the scoop slot effectively larger or smaller. Further, the leading edges of the wear plates can be selected to carry out various functions, for example, a beveled cutting edge.

The leading edge of the rear bottom section can be beveled to provide a cutting edge. Further, the wear plate(s) can be provided with a beveled cutting edge at the leading edge thereof. The wear plate(s) can be positioned to provide a double or triple cutting edge, or can be positioned to provide a continuous cutting edge/surface with the beveled cutting edge of the rear bottom section of the bucket.

BRIEF DESCRIPTION OF THE INVENTION

DETAILED DESCRIPTION OF PREFERRED EMBODIMENTS

The present invention is directed to excavation buckets, in particular backhoe and excavator buckets for trenching. However, the present invention can be applied to other types of buckets such as front loaders and other types of excavation equipment.

Figure 1:
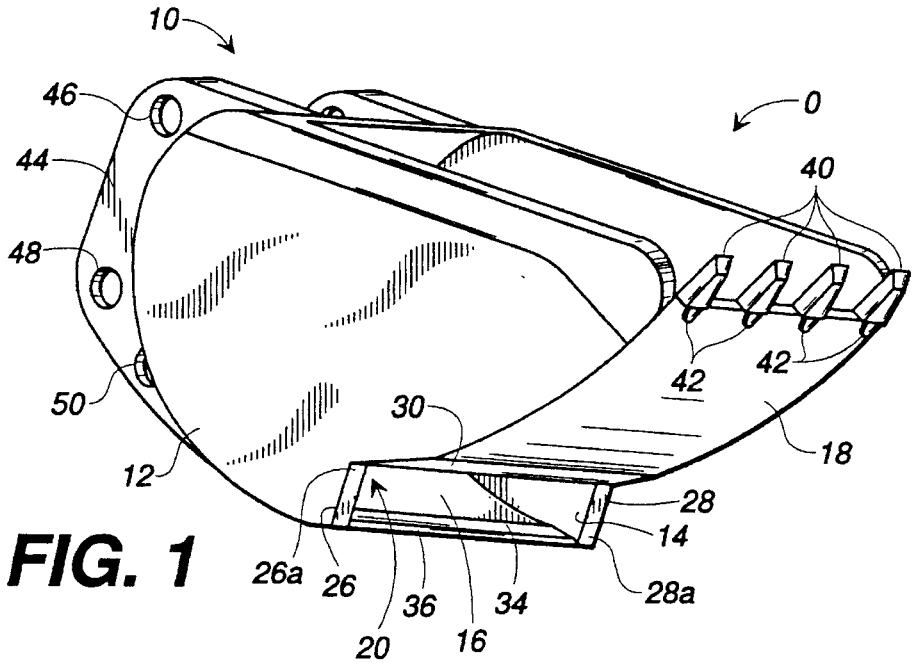
FIG. 1 is a pictorial view of an excavation bucket according to a first preferred embodiment of the present invention.
Figure 2:
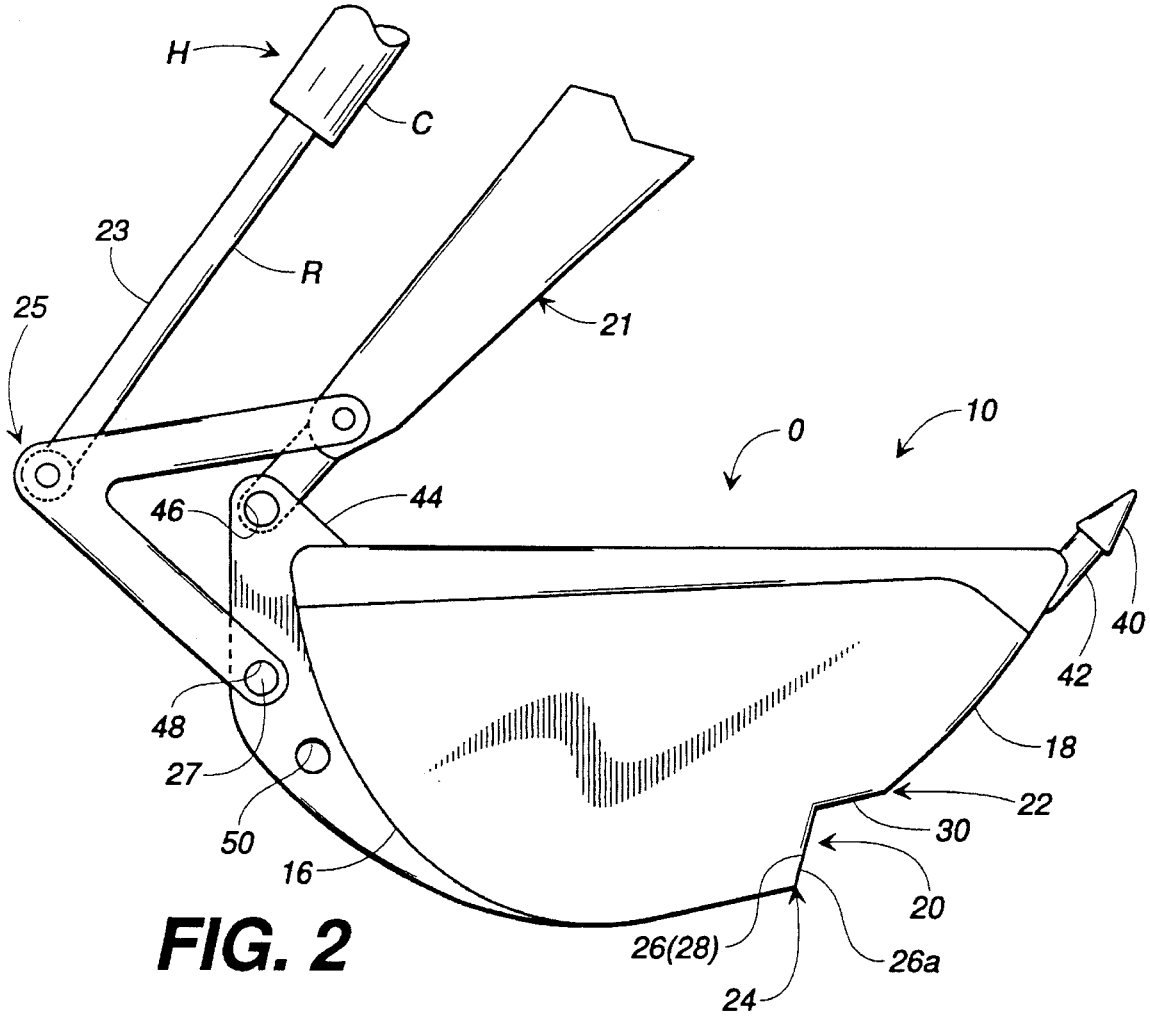
FIG. 2 is a side elevation view of the bucket as shown in FIG. 1, together with a fragmentary showing a conventional arm and operating cylinder for supporting the bucket.
Figure 3:
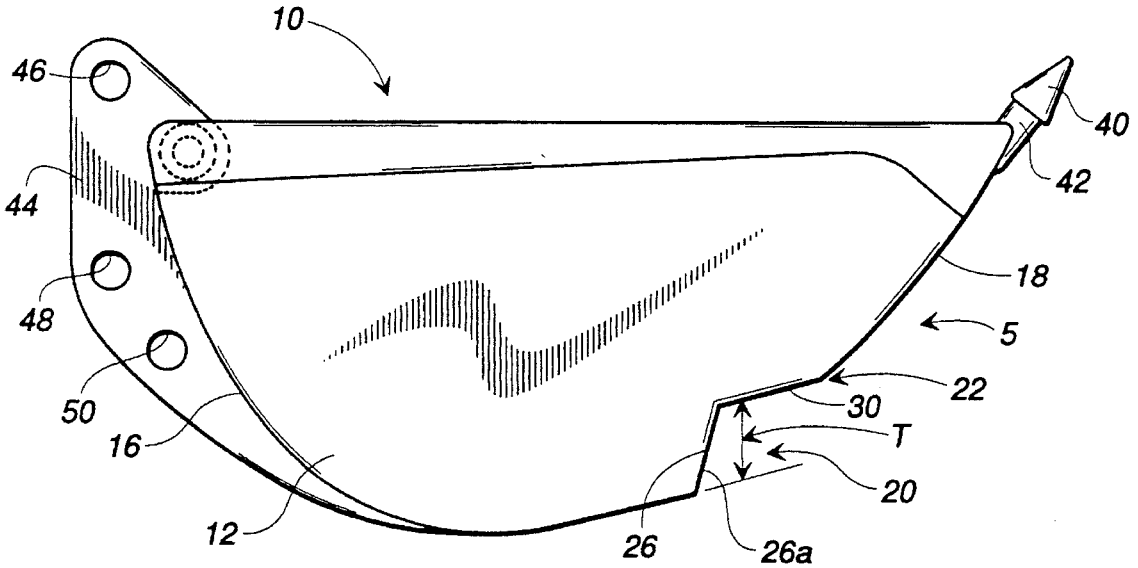
FIG. 3 is a side elevation view of the bucket shown in FIG. 2 indicating the configuration of the side plates.

A first preferred embodiment of an excavation bucket according to the present invention is shown in FIGS. 1–6 and is designated generally by the numeral 10. The excavation bucket 10 comprises a pair of upstanding side plates 12 and 14 connected together by a rear bottom assembly 16 and a front bottom assembly 18. Edges defined along portions of the side plates 12 and 14 and along portions of the rear and front bottom assemblies 16 and 18 are joined together, by welding for example, to form a structure having an upper opening O for material introduction, and to define a bucket material volume therein. In the excavation bucket 10 the side plates 12 and 14 have a generally D-shaped configuration as shown in FIG. 3.

The excavation bucket 10 further includes a pair of connector plates 44 attached to one end of the rear bottom assembly 16 and used for connecting the excavation bucket to other excavation equipment, such as a tractor. Each connector plate 44 defines a mounting aperture 46 and articulation apertures 48 and 50. Referring to FIG. 2, the bucket 10 is illustrated as attached to a support arm 21 and hydraulic cylinder H of a backhoe (not shown) in a conventional manner. The hydraulic cylinder H, which includes a telescoping rod R, is attached to the support arm 21. A distal end 23 of the rod R connects to an articulation assembly 25. The articulation assembly 25 attaches pivotally to the bucket through a spindle 27, and rotates the bucket 10 counterclockwise or clockwise around the mounting aperture 46 as the rod R is extended from the cylinder C, or retracted into the cylinder.

Figure 4:
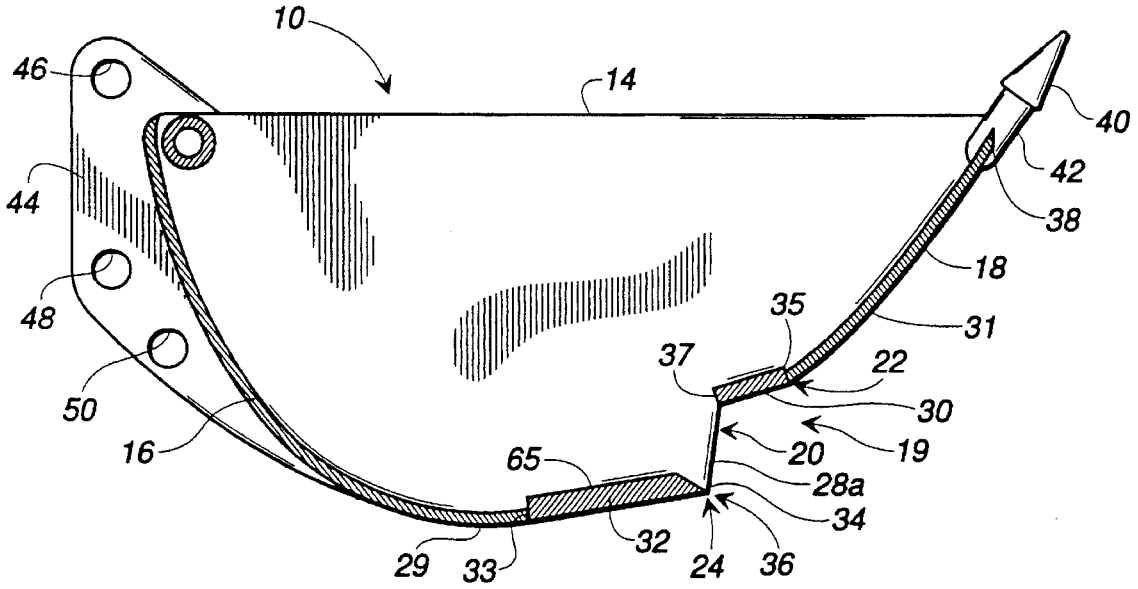
FIG. 4 is a lengthwise cross-section view of the bucket shown in FIG. 2.
Figure 5:
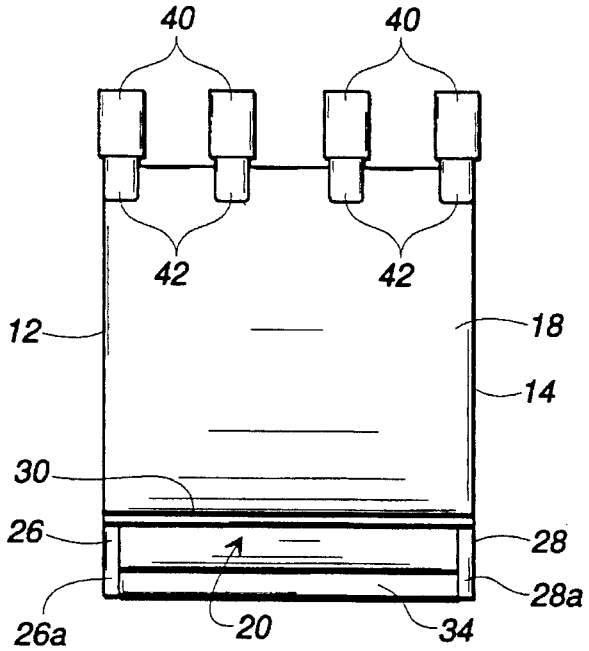
FIG. 5 is a front elevation view of the bucket as seen from the right side of FIG. 2.

Looking now at FIG. 4, the rear bottom assembly 16 comprises an arcuate rear plate 29 and a grading plate 32. The grading plate 32 defines edges 33 and 34. Edge 33 of the grading plate 32 engages the rear plate 29 and is secured thereto by conventional means, including welding. The edge 34 is a beveled edge which provides a cutting edge 36 to facilitate fine-grading. In the embodiment shown in FIG. 4, the grading plate 32 is thicker than the rear plate 30 which gives the grading plate 32 greater strength, longevity and robust performance.

The front bottom assembly 18 includes an arcuate front bottom plate 31 and a transverse plate 30. The front bottom plate 31 defines a trailing edge 22, which engages the transverse plate 30, and a leading edge 38 to which is mounted a plurality of teeth 40 by supports 42 welded to the front bottom plate 31 adjacent the leading edge 38.

The transverse plate 30 defines edges 35 and 37. The forward edge 35 of the transverse plate 30 is welded to edge 22 of the front bottom plate 31. The transverse plate 30 is also welded, at its ends, to the side plates 12 and 14. The rearward edge 37 of the transverse plate 30 is elevated above the edge 34 of the grading plate 32 to provide a scoop 19 defining a scoop slot opening 20. More particularly, the scoop slot opening 20 is defined by the rearward edge 37 of the transverse plate 30, by the beveled edge 34 of the grading plate 32, and by the triangular notched portions 26 and 28 disposed in the side plates 12 and 14. The triangular notched portions 26 and 28, shown in FIG. 5, expose forward facing surfaces 26*a* and 28*a*, respectively, of the side plates 12 and 14. The grading plate 32 is spaced relative to plate 30 in substantially co-planar orientation and at a distance T apart as shown in FIG. 3. The distance T defines the maximum thickness of material removable by the scoop 19 in a single pass of the bucket 10 used in a fine-grading mode. The orientation of the grating plate 32 relative to the transverse plate 30 may be varied as required for particular bucket configurations.

Figure 6:
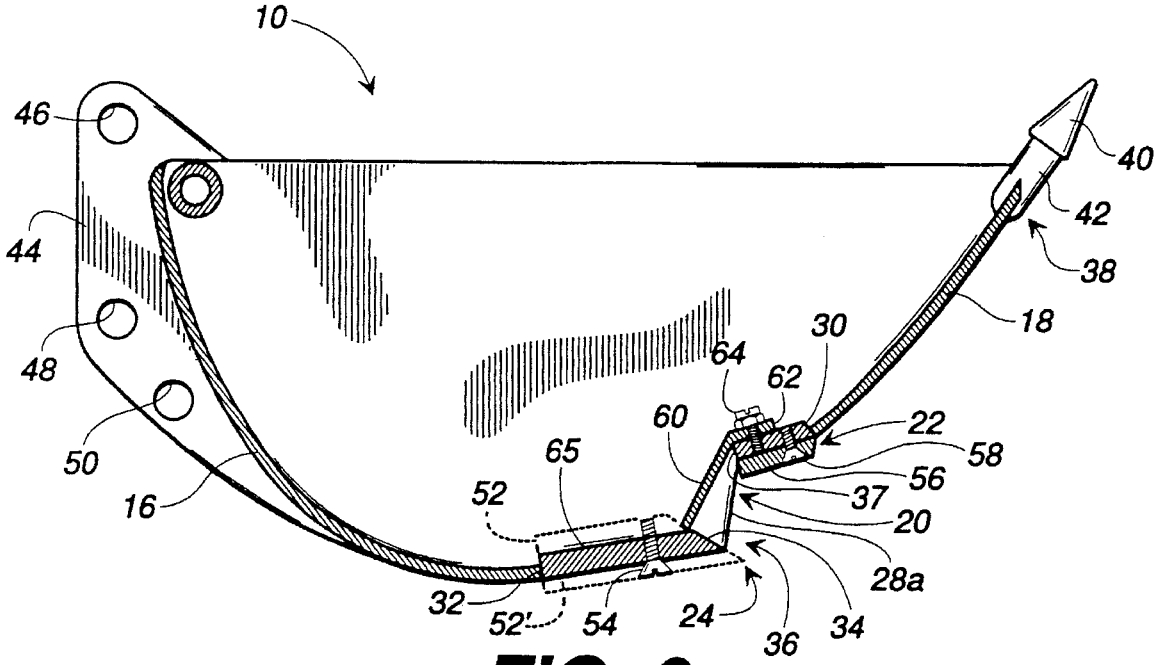
FIG. 6 is a lengthwise cross-section view of the bucket shown in FIG. 4, modified with the addition of a closure for the scoop.

The excavation bucket 10 can be provided with optional features, as shown in FIG. 6. The grading plate 32 can optionally be provided with an upper wear plate 52, or a lower wear plate 52', or both. The wear plate(s) can be secured to the grading plate 32 by one or more threaded fasteners 54, or by other conventional means. The application of the wear plate(s) 52 and 52' modifies the dimensions and configuration of the scoop opening 20 to be larger or smaller as desired for a particular application. The wear plates 52 and 52' can be fabricated and positioned so that the beveled cutting edges 34 are continuous and, thus, maintain the bevel angle of bevel edge 34. Alternatively, the effective bevel angle of the edge 34 of the grading plate 32 can be modified by changing the angle of the leading edge of the lower wear plate 52'.

The transverse plate 30 can optionally be provided with a lower wear plate 56. The wear plate 56 can be secured to the transverse plate 30 by one or more threaded fasteners 58, or by other conventional means. The application of the wear plate 56 modifies the dimensions and configuration of the scoop opening 20 to be smaller as desired for a particular application. Further, the angle of the upper leading edge of the scoop can be modified by simply changing the angle of the leading edge of the wear plate 56.

The wear plates 52, 52', and 56 described above can be replaced, or removed and repaired, when worn or damaged. Further, various combinations of wear plates can provide numerous configurations tailored to particular applications.

The scoop 19 can be provided with a resilient flap 60, shown in FIG. 6, to allow material to enter the bucket 10 through the scoop opening 20, and to prevent material, once in the bucket, from undesirably exiting the bucket 10 through the scoop opening 20. The resilient flap 60 can be fabricated or molded to a variety of different configurations suitable to accomplish this task. For example, the resilient flap 60 can have an upside-down L-shaped configuration. A metal strip 62 secured by one or more threaded fasteners 64 can securely fasten the resilient flap 60 to the transverse plate 30.

In the embodiment shown in FIG. 6, the resilient flap 60 is connected adjacent to edge 37 of the transverse plate 30, and extends downwardly blocking the scoop opening 20. The resilient flap 60 is of sufficient length that it contacts an upper surface 65 of the grading plate 32 to prevent portions of the flap 60 from being expelled out of the scoop opening 20 under the force of excavated material within the bucket 10.

Alternatively, the resilient flap 60 may be attached to the grading plate 32 so that the flap 60 extends upwardly therefrom and seals against edge 37 of the transverse plate 30.

Figure 7:
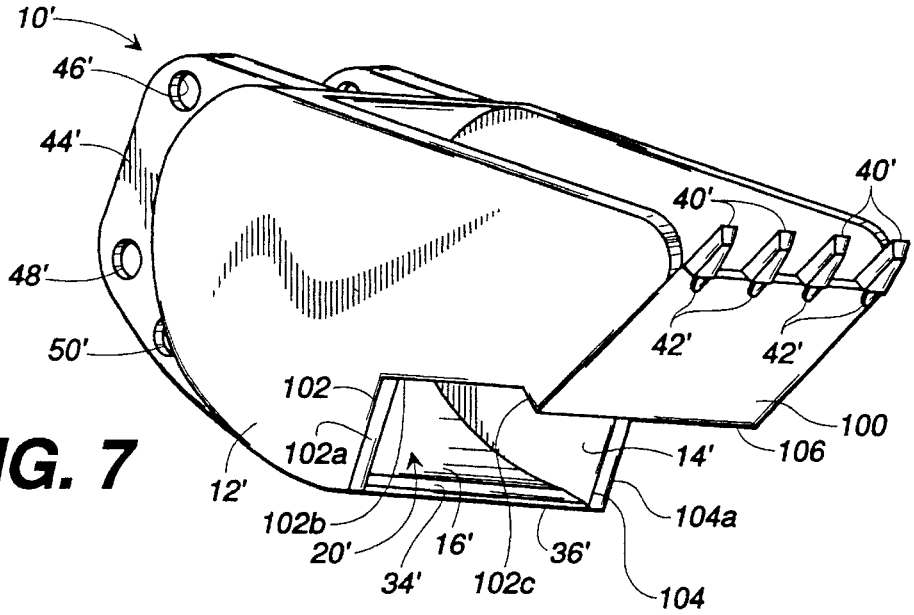
FIG. 7 is a pictorial view of another embodiment of the bucket according to the present invention.

A second embodiment of a backhoe bucket according to the present invention is shown in FIG. 7 and is generally designated by the numeral 10'.

The bucket 10' includes a flat front bottom assembly 100 and upstanding side plates 12' and 14'. The sides 12' and 14' are provided with C-shaped notches 102 and 104 exposing surfaces 102*a*, 102*b*, 102*c*, and 104*a*. A transverse face 106 is exposed in the entrance of the scoop 20'. The transverse face 106 can be used for grading when the backhoe bucket 10' is moved away from the excavation equipment while the cutting edge 36' is used for grading when pulling the backhoe bucket 10' toward the excavation equipment.

Figure 8:
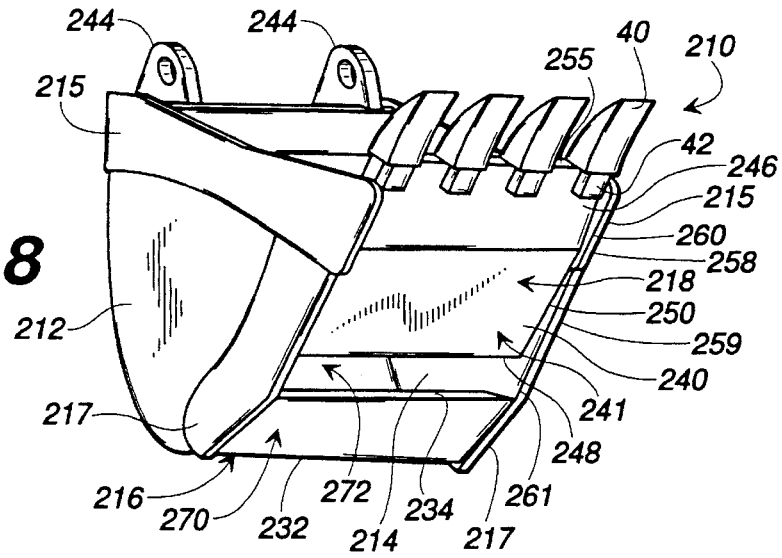
FIG. 8 is a pictorial view of another embodiment of the bucket according to the present invention.
Figure 9:
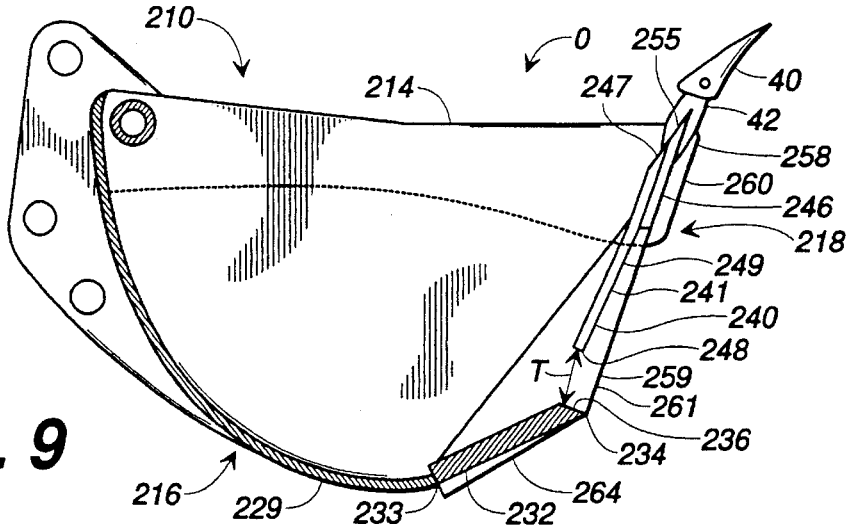
FIG. 9 is a lengthwise cross-section view of the bucket shown in FIG. 8.
Figure 10:
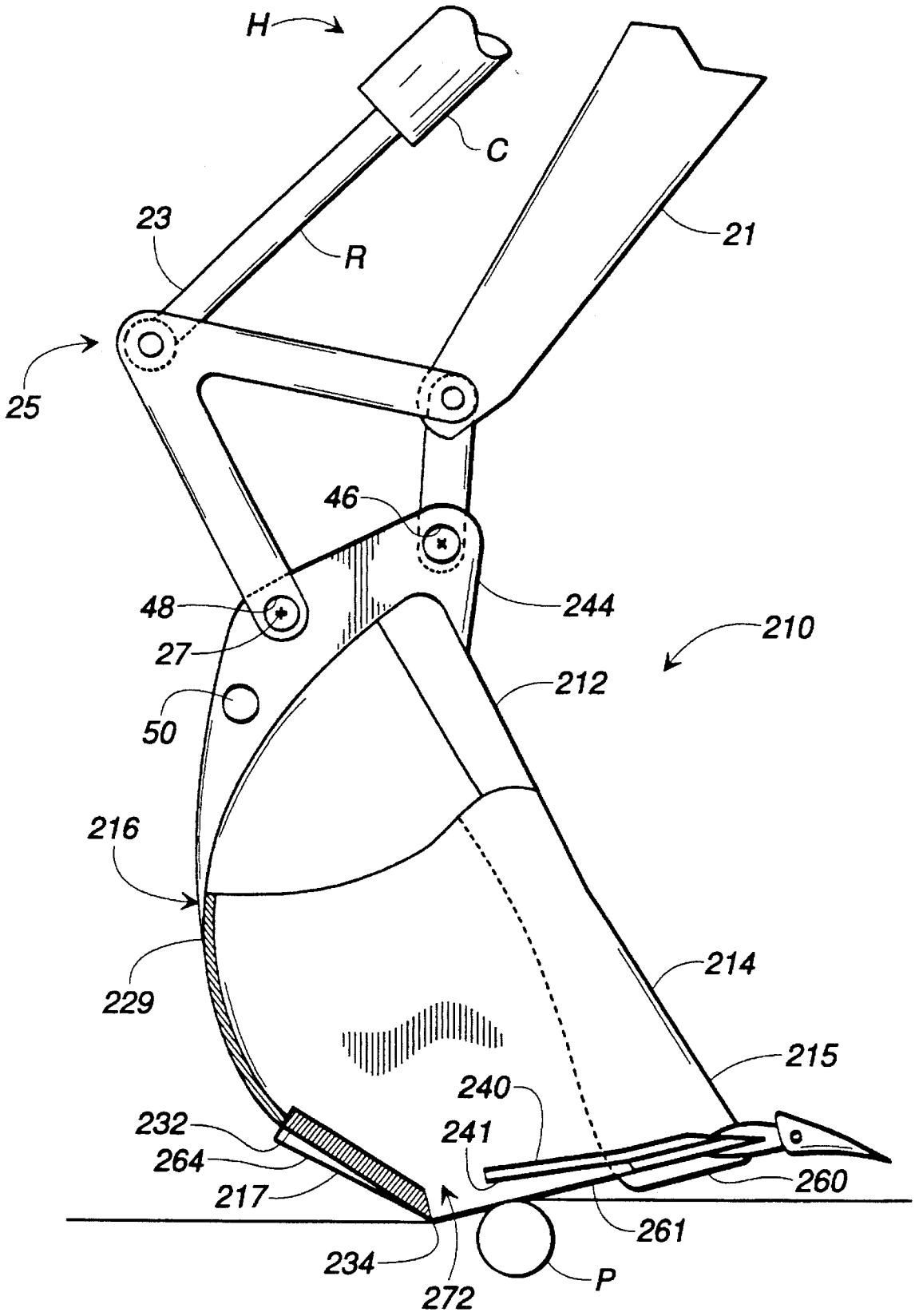
FIG. 10 is an illustrative view of the bucket of FIG. 8 shown fine-grading material from a trench and engaging a buried object.

A third preferred embodiment of the excavation bucket of the present invention is shown in FIGS. 8–10 and is generally designated by the numeral 210. The bucket 210 comprises upstanding side plates 212 and 214, and a rear bottom assembly 216 and a front bottom assembly 218 secured between the side plates 212 and 214. The bucket 210 further includes a pair of connector plates 244, attached to one end of the rear bottom assembly 216, for connecting the bucket 210 in supported and articulating engagement with a backhoe arm 21, shown in FIG. 10, in a conventional manner. The bucket 210 also includes upper and lower bucket guide plates 215 and 217, respectively, secured to each of the side plates 212 and 214. The bucket guides 215 and 217, which are described in greater detail hereinbelow, are effective to cause the bucket 210 to ride over objects buried in the material to be excavated when the bucket 210, disposed in the scoop grading mode, engages the object. These buried objects include, for example, electrical conduits and gas and water service pipes buried below grade.

The rear bottom assembly 216 includes an arcuate rear plate 229 and a grading plate 232 attached to the forward edge of the rear plate 229. The grading plate 232 defines substantially parallel transverse edges 233 and 234. The rear transverse edge 233 of the grading plate 232 engages the forward edge of the rear plate 229 and is secured thereto by conventional means, including welding. The front transverse edge 234 may be provided with a bevel 236 to facilitate fine-grading.

The front bottom assembly 218 includes a planar front bottom plate 240 and a tooth mounting and reinforcing plate 246. The front bottom plate 240 defines an outer support surface 241 and includes parallel transverse edges 247 and 248 and side edges 249 and 250. A lower portion of the tooth mounting and reinforcing plate 246 overlays, and is welded to, a portion of the front bottom plate 240 adjacent the upper edge 247 so as to reinforce the front bottom plate 240. A plurality of tooth supports 42, each mounting a tooth 40, is attached to an upper edge 255 of the tooth mounting and reinforcing plate 246.

The upper bucket guide plates 215 are attached to the side plates 212 and 214, adjacent the bucket opening O, and tend to reinforce the side plates 212 and 214. Each of the upper bucket guide plates 215 includes an upper guide edge 258 that extends past the tooth mounting and reinforcing plate 246 a prescribed distance and at generally right angles to the tooth mounting and reinforcing plate 246. The upper guide edge 258 defines an upper guide surface 260 on each side of the bucket 210.

The lower bucket guide plates 217 extend downwardly from the forward ends of the upper guide plates 215 to the grading plate 232, and attach by welding to the side plates 212 and 214, the opposed ends of the grading plate 232, and the side edges 249 and 250 of the front bottom plate 240. Each lower bucket guide plate 217 includes a longitudinal lower guide edge 259 that extends past the front bottom plate 240 a prescribed distance and substantially perpendicular thereto. The lower guide edge 259 thus defines a lower guide surface 261 which extends from the upper bucket guide plate 215 to the edge 234 of the grading plate 232. The lower guide surface 261 extends coincident to or slightly outward of the edge 234 of the grading plate 232. The lower bucket guide plate 217 also includes a clearance edge 264 which extends from the grading edge 234 to the grading plate edge 233 and slightly below the grading plate 232.

The edge 248 of the front bottom plate 240 is disposed in spaced-apart relation to the edge 234 of the grading plate 232 a distance T. The front bottom plate edge 248, the grading plate edge 234 and the lower guide edges 259 thus provide a scoop 270 defining a scoop slot opening 272. The distance T defines the maximum thickness of material that is removable in a single pass of the scoop 270 through the material to be excavated.

Operation

The backhoe bucket 10 is capable of being used for digging trenches and the like in a conventional manner in a first digging mode and for fine-grading material in a second digging mode. In the first digging mode the teeth 40 of the bucket 10 are forced into the material to be excavated and then the bucket 10 is rotated and drawn toward the backhoe tractor, filling the bucket 10 with dislodged material. The bucket 10 is emptied in a conventional manner.

At some point the backhoe operator may desire to fine-grade the bottom of the trench or suspects that a buried object is near the bottom of the trench. The operator changes the bucket operation to the second digging mode whereby the operator rotates the bucket 10 so that the grading plate edge 34 engages the trench bottom surface and the teeth 40 are spaced above and out of contact with the trench bottom surface. As the bucket 10 is drawn toward the tractor, the grading plate edge 34 planes beneath the trench bottom surface, due to the bevel edge 36, and continues deeper into the trench bottom until the front bottom plate 31 engages the trench bottom surface and supports the bucket 10 relative to the trench bottom as the bucket 10 is drawn toward the tractor. A uniform layer of material having a thickness T is removed from the trench as the bucket 10 is drawn ever closer to the tractor. The fine-graded material passes through the scoop opening 20 and accumulates in the bucket 10. The accumulated material is disposed of in a conventional manner.

The operation of the backhoe bucket 210 as shown in FIGS. 8–10 is described in detail below.

The backhoe bucket 210 is used as described above for conventional excavation of material during trenching operations. When the backhoe operator desires to fine-grade the trench bottom the operator rotates the bucket 210 so that the grading plate edge 234 engages the trench bottom surface and the teeth 40 are spaced above and out of contact with the trench bottom surface. As the bucket 210 is drawn toward the tractor, the grading plate edge 234 planes beneath the trench bottom surface, due to the bevel edge 236, and continues deeper into the trench bottom until the outer support surface 241 of the front bottom plate 240 engages the trench bottom surface and supports the bucket 210 relative to the trench bottom surface as it is drawn toward the tractor. At this point a uniform layer of material having a thickness T is removed from the trench as the bucket 210 is drawn ever closer to the tractor. The fine-graded material passes through the scoop opening 272 and accumulates in the bucket 210. The accumulated material is disposed of in a conventional manner.

In FIG. 10 there is shown the bucket 210 fine-grading a trench and engaging a buried object P lying in the excavation path. The object P is a cylindrically shaped object such as a pipe and is disposed transverse to the movement of the bucket 210. It should be understood that the efficacy of the bucket 210 to fine-grade near buried objects is not limited to only cylindrically shaped buried objects. The bucket 210 is capable of fine-grading near other tubular structures having non-circular transverse cross-section shapes. As the bucket 210 approaches the object P the lower guide surface 261 of the lower bucket guide plate 217 contacts the object as shown in FIG. 10, causing the bucket to be thrust in an upward direction, while still fine-grading material as the bucket 210 is drawn toward the tractor. As the bucket 210 continues to be drawn horizontally toward the tractor, the point of engagement of the object P along the lower guide surface 261 advances towards the point at which the lower guide surface 261 is adjacent to the grading plate edge 234. Because the lower guide surface 261 extends coincident to or slightly outwardly of the edge 234, the edge 234 is unable to engage the object P sufficient to damage or excavate the object P as the edge 234 passes over the object P. As the bucket 210 advances even further horizontally, the bucket 210 remains supported above the object P along the clearance edge 264 of the lower bucket guide plate 217 and then resumes fine-grading when the object P disengages the clearance edge 264. Advantageously, an upper portion of the outer surface of the object P becomes visible to the operator.

I claim:

1. An excavation bucket, comprising:

a pair of upstanding side plates;

a rear curved bottom section connecting together said pair of upstanding side plates at a rear portion of the excavation bucket; and a front curved bottom section connecting together said pair of side plates at a front portion of the excavation bucket, said rear curved bottom section and said front curved bottom section being set apart and configured to define a scoop in a bottom of the excavation bucket to allow fine-grading with said scoop.

2. An excavation bucket according to claim 1, wherein said rear curved bottom section includes a leading edge for fine-grading located at an entrance into said scoop and said front curved bottom section includes a trailing edge adjacent said scoop.

3. An excavation bucket according to claim 2, wherein said leading edge of said rear curved bottom section extends below said trailing edge of said front curved bottom section defining said scoop.

4. An excavation bucket according to claim 2, wherein said rear curved bottom section is provided with a wear plate at said leading edge.

5. An excavation bucket according to claim 2, wherein said trailing edge of said front curved bottom section is provided with a lower wear plate.

6. An excavation bucket according to claim 2, wherein the bucket is provided with a resilient flap covering said scoop to allow material to enter through the scoop into the bucket while preventing material from exiting through the scoop.

7. An apparatus for excavating material from material to be excavated comprising:

opposed upstanding side plates; and a bottom assembly extending laterally from and disposed in engagement with said side plates so as to form an excavation bucket defining an interior material volume therein and a bucket opening thereinto, said bottom assembly forming a scoop defining a scoop slot extending between portions of said bottom assembly, said scoop slot defining a scoop opening into the excavation bucket and being capable of excavating material by fine-grading the material to be excavated as the bucket is moved relative to the material to be excavated and, the bucket opening being located on the bucket in relation to the scoop slot so that the bucket opening is spaced above and out of contact with the material being excavated when the bucket is positioned to fine grade the material.

8. The apparatus of claim 7 wherein said bottom assembly includes a front bottom section and a rear bottom section, said front bottom section comprising a front bottom plate joining together opposed portions of said side plates and defining a front lagging edge, and said rear bottom section comprising a rear bottom plate joining together opposed portions of said side plates and defining a rear leading edge, said front lagging edge of said front bottom plate being disposed adjacent to and in spaced apart relation with said rear leading edge of said rear bottom plate so as to define said scoop slot therebetween, said scoop further including at least one excavation cutting edge adjacent said scoop slot.

9. The apparatus of claim 8 wherein said front bottom plate is substantially planar.

10. The apparatus of claim 8 wherein said front bottom plate is substantially arcuate.

11. An apparatus for excavating material from material to be excavated, comprising:

opposed upstanding side plates;

a bottom assembly extending laterally from and disposed in engagement with said side plates so as to form an excavation bucket defining an interior material volume therein and a bucket opening thereinto;

said bottom assembly forming a scoop defining a scoop slot extending between portions of said bottom assembly;

said scoop slot defining a scoop opening into the excavation bucket and being capable of excavating material by fine-grading the material to be excavated as the bucket is moved relative to the material to be excavated;

said bottom assembly including a front bottom section and a rear bottom section, said front bottom section comprising a front bottom plate joining together opposed portions of said side plates and defining a front lagging edge, and said rear bottom section comprising a rear bottom plate joining together opposed portions of said side plates and defining a rear leading edge;

said front lagging edge of said front bottom plate being disposed adjacent to and in spaced apart relation with said rear leading edge of said rear bottom plate so as to define said scoop slot therebetween, said scoop further including at least one excavation cutting edge adjacent said scoop slot; and said rear leading edge of said rear bottom plate is disposed lower relative to the bucket opening than said front lagging edge of said front bottom plate.

12. An apparatus for excavating material from material to be excavated, comprising:

opposed upstanding side plates;

a bottom assembly extending laterally from and disposed in engagement with said side plates so as to form an excavation bucket defining an interior material volume therein and a bucket opening thereinto;

said bottom assembly forming a scoop defining a scoop slot extending between portions of said bottom assembly;

said scoop slot defining a scoop opening into the excavation bucket and being capable of excavating material by fine-grading the material to be excavated as the bucket is moved relative to the material to be excavated;

said bottom assembly including a front bottom section and a rear bottom section, said front bottom section comprising a front bottom plate joining together opposed portions of said side plates and defining a front lagging edge, and said rear bottom section comprising a rear bottom plate joining together opposed portions of said side plates and defining a rear leading edge;

said front lagging edge of said front bottom plate being disposed adjacent to and in spaced apart relation with said rear leading edge of said rear bottom plate so as to define said scoop slot therebetween, said scoop further including at least one excavation cutting edge adjacent said scoop slot; and guide means disposed adjacent said scoop slot and being operative to prevent excavation of objects lying in the excavation path by preventing said scoop opening from engaging said objects as said scoop is moved relative to the objects.

13. The apparatus of claim 12 wherein said guide means includes a guide plate assembly including at least one guide plate defining a guide surface thereon, said guide plate assembly being disposed adjacent said scoop slot so that said guide surface is coincident with said excavation cutting edge adjacent said scoop slot.

14. The apparatus of claim 12 wherein said guide means includes a guide plate assembly including at least one guide plate defining a guide surface thereon, said guide plate assembly being disposed adjacent said scoop slot so that said guide surface is spaced-apart from said excavation cutting edge adjacent said scoop slot.

15. An excavation bucket for excavating material from material to be excavated, comprising:

a bucket having a front edge for excavating material in a first operating mode, and a scoop defining a scoop slot opening into said bucket for fine-grading material in a second operating mode, wherein, when said bucket is operated in said second operating mode said front edge is maintained out of contact with the material to be excavated.

16. A method of digging material using a backhoe provided with a backhoe bucket having a front edge for excavating material in a first mode and having a scoop defining a scoop slot opening into the bucket for fine-grading material in a second mode, comprising the steps of:

excavating material with the bucket operated in a first mode;

fine-grading material with the bucket operated in a second mode;

the step of excavating material with the bucket in the first mode comprising drawing the bucket through the material with the front edge lowered to excavate the material into the bucket; and the step of fine-grading material with the bucket in the second mode comprising drawing the bucket through the material with the front edge maintained out of contact with the material while material is fine-graded through the scoop slot and into the bucket.

17. An apparatus for excavating material from material to be excavated, comprising:

opposed upstanding side plates; and a bottom assembly extending laterally from and disposed in engagement with said side plates so as to form an excavation bucket defining an interior material volume therein and a bucket opening thereinto;

said bottom assembly forming a scoop defining a scoop slot extending between portions of said bottom assembly;

said scoop slot defining a scoop opening into the excavation bucket and being capable of excavating material by fine-grading the material to be excavated as the bucket is moved relative to the material to be excavated; and guide means disposed adjacent said scoop slot and being operative to prevent excavation of objects lying in the excavation path by preventing said scoop slot from engaging said objects as said scoop is moved relative to the objects.

18. The apparatus of claim 17 wherein said guide means includes a guide plate assembly including at least one guide plate defining a guide surface thereon, said guide plate assembly being disposed adjacent said scoop slot so that said guide surface is coincident with an excavation cutting edge of the scoop adjacent said scoop slot.

19. The apparatus of claim 17 wherein said guide means includes a guide plate assembly including at least one guide plate defining a guide surface thereon, said guide plate assembly being disposed adjacent said scoop slot so that said guide surface is spaced apart from an excavation cutting edge of the scoop adjacent said scoop slot.

* * * * *